United States Patent [19]

Gringer

[11] Patent Number: 4,753,471

[45] Date of Patent: Jun. 28, 1988

[54] HAWK HAVING MULTIPOSITION HANDLE

[75] Inventor: Donald Gringer, Bedford, N.Y.

[73] Assignee: Allway Tools, Inc., Bronx, N.Y.

[21] Appl. No.: 37,614

[22] Filed: Apr. 13, 1987

[51] Int. Cl.[4] ..... E04G 21/16

[52] U.S. Cl. ..... 294/3.5

[58] Field of Search ..... 294/3.5, 167; 15/235.4–235.8, 257 R, 257.05, 257.06, 257.7; 16/114 R

[56] References Cited

U.S. PATENT DOCUMENTS

| | | | |
|---|---|---|---|
| 1,348,516 | 8/1920 | Peck | 294/3.5 |
| 1,737,274 | 11/1929 | Sudek | 294/3.5 |
| 1,851,497 | 3/1932 | Darling | 294/3.5 X |
| 1,865,885 | 7/1932 | Byhre | 294/3.5 |
| 2,912,851 | 11/1959 | Karnes | 15/235.5 |
| 3,206,788 | 9/1965 | Hahn | 15/235.8 |
| 3,790,201 | 2/1974 | Morsilli | 294/3.5 |
| 3,916,472 | 11/1975 | Carder | 15/235.6 |

*Primary Examiner*—Johnny D. Cherry

*Attorney, Agent, or Firm*—Stiefel, Gross & Kurland

[57] ABSTRACT

An improved hawk comprises a planar work surface or blade (10) and a multiposition, removably mountable handle (12), removably mountable to the blade (10) in a plurality of different optimal positions for use, storage, packing and/or display. The handle (12) includes a pair of holes (18) which snap-fit together with mushroom pins (16) on the work surface to facilitate mounting in a storage and/or hanging position, with the handle having a tab (24) having an aperture (26) therein which extends beyond the edge of the blade (10) in the hanging position. The handle (12) also includes threads (20) for threadably mounting the handle (12) to the blade (10) in a working position.

7 Claims, 2 Drawing Sheets

FIG. 5
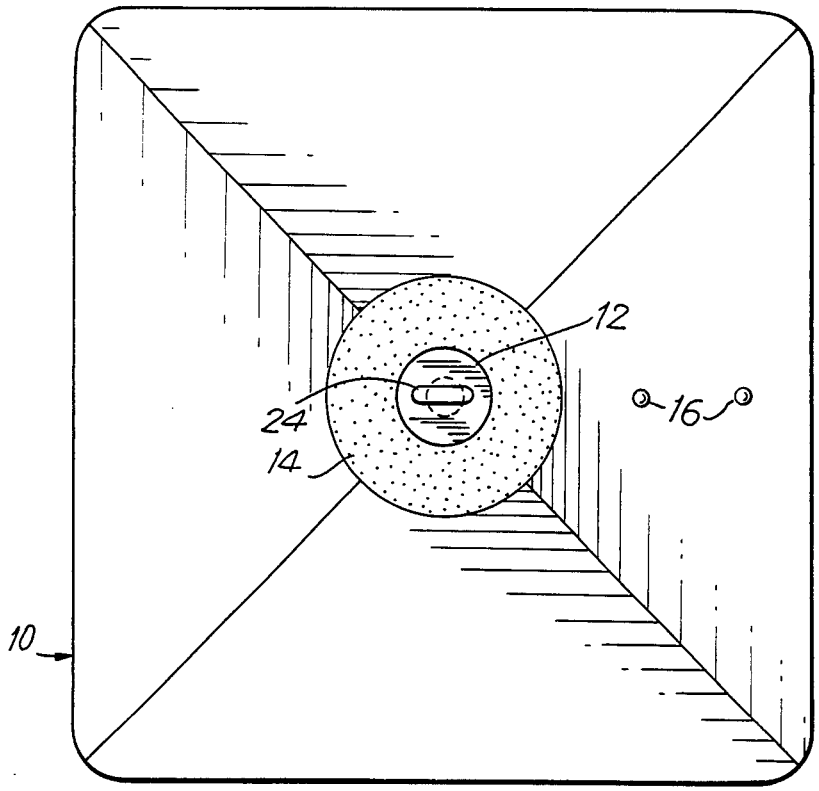
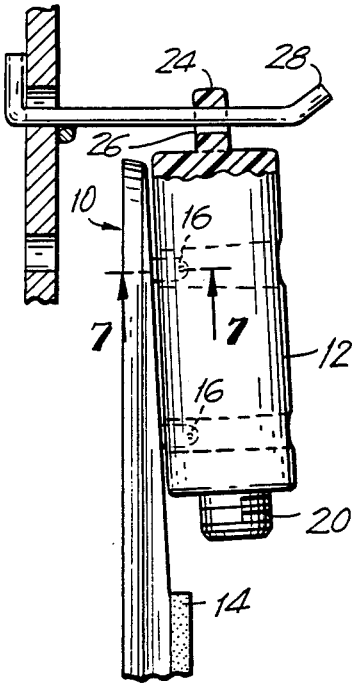
FIG. 6
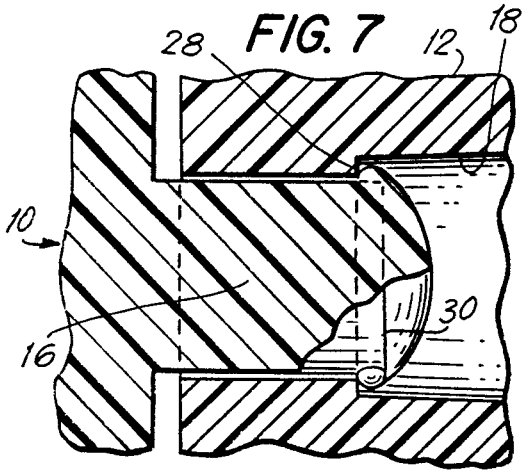
FIG. 7

HAWK HAVING MULTIPOSITION HANDLE

BACKGROUND OF THE INVENTION

The present invention relates to hawks that are used by masons to carry mortar or plaster-like material to a wall or other work surface for application thereto. More particularly, this invention relates to a hawk with a removably attachable multiposition handle where the handle may be positioned in various different optimum positions for work, packing or hanging.

Hand tools, including hawks, having removable handles are generally known in the art. See, e.g. U.S. Pat. Nos. 3,916,472; 3,206,788; 3,013,291; 2,912,851; 2,880,443; 2,217,369; 1,726,119; and 1,078,122. Additionally, it is known in the art that removable handles may have portions for hanging the tool to which they are attached. See e.g. U.S Pat. No. 3,214,778 and Design Pat. No. 247,075. However, it is not known that a removable handle may be detached from the tool, and then reattached to the work surface of the tool in a variety of totally different optimum positions such that the hanging portion of the handle is exposed and thereby optimally facilitate hanging of the tool in a compact, knock-down form for storage or display or for shipment or packing of the tool.

Generally, hawks are comprised of large planar work surfaces, substantially square, having a handle removably attached in a perpendicular position extending from the center of the planar surface. The handle is attached to the opposite side of the work surface and usually extends about 5 or 6 inches from the planar surface for facilitating the carrying of the hawk by the mason. However, the handle cannot be reattached to the hawk in a compact position to facilitate packing either for shipment or by the workman in his workbag and, moreover, cannot be attached in a compact manner to readily facilitate hanging of the hawk in a workroom or for display in a store. Thus, there are disadvantages in the normal configuration of the hawk which result from it being a bulky, cumbersome tool, that is awkwardly packaged, shipped, displayed and stored.

In accordance with the present invention, the hawk of the type described consists of a removable handle, such that the handle may be detached from the work position of the planar surface and then reattached in a flat position parallel to and on the opposite side of the working surface. In such a position, the hawk is in a substantially flat configuration whereby storage and packing become significantly facilitated. In addition, the handle has a portion for hanging the hawk for display or storage purposes, such that the hanging position is different from the packing position. Thus, the work portion and the handle preferably comprise the only two separate components of the hawk providing fewer pieces to be misplaced or lost than in known hawks while providing optimum flexibility. Additionally, the work portion and the handle can be manufactured simultaneously by injection molding techniques, thus resulting in lower manufacturing costs over hawks known in the art.

SUMMARY OF THE INVENTION

An improved hawk providing a more compact, easily handling configuration for packing, displaying, shipping and storing the hawk by utilizing a multiposition handle removably mountable to the rear of the hawk work surface. The improved hawk comprises a planar member having a working surface and a mounting surface on the opposite side of the working surface, the working surface being capable of holding mortar or plaster-like material thereon when used in a work position and means for removably mounting a handle in a plurality of optimal positions for use, storage, packing and/or display; and a removably attachable handle comprising a hanging portion and mounting means for removably mounting the handle to the planar member in various optimal positions comprising the working position, the packing or shipping position, and the display or hanging position.

BRIEF DESCRIPTION OF THE DRAWINGS

To facilitate further description of the invention, the following drawings are provided in which:

FIG. 5 is a bottom view of the hawk of FIG. 3 with the handle in the working position;

FIG. 6 is a sectional view of the hawk of FIG. 1 in a hanging position, showing the handle extending beyond the edge of the hawk to facilitate hanging; and FIG. 7 is an enlarged view of the snap fit of the handle of FIG. 6 in the hanging position.

Figures 1, 2, 3, 4:
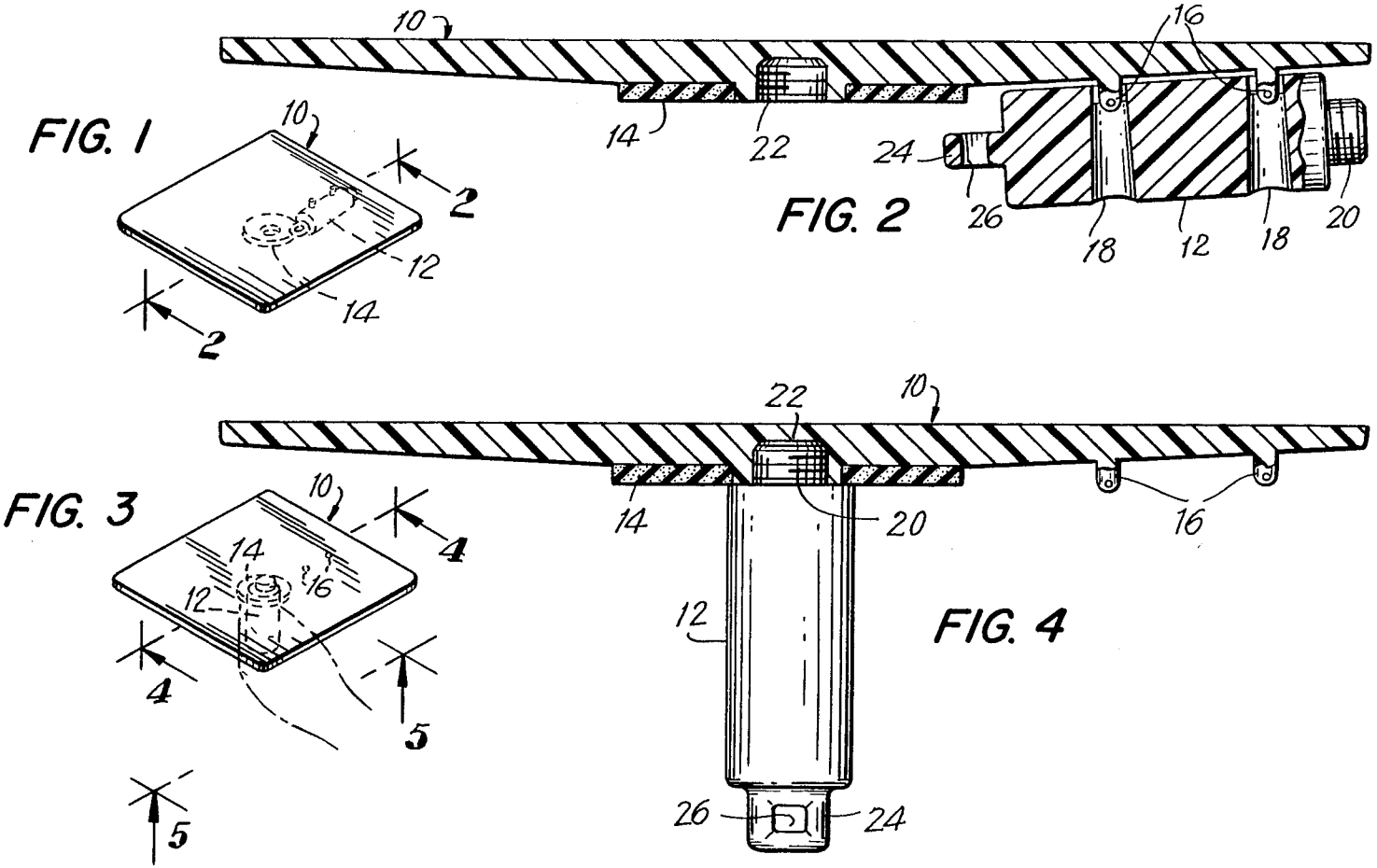
FIG. 1 is a top view of a hawk in accordance with the present invention with the handle in a packing position.
FIG. 2 is a cross-sectional view of the hawk of FIG. 1 with the handle in a packing position.
FIG. 3 is a top view of the hawk of FIG. 1 with the handle in a working position.
FIG. 4 is a cross-sectional view of the hawk of FIG. 3 with the handle in the working position.

It should be understood that the drawings are for illustrative purposes only and should not be construed to limit the scope of the invention.

DETAILED DESCRIPTION OF THE INVENTION

In a preferred embodiment, the hawk is manufactured from polypropylene foam in a one step injection process whereby the handle 12 and the blade 10 are formed simultaneously. Other materials such as metals, plastics, or wood known by one skilled in the art, may be substituted. Generally, the blade 10 is square, although other shapes, such as rectangular, are not precluded.

Because the hawk of the present invention is preferably produced by an injection molding process, only two pieces result The mushroom shaped pins 16 extending from the underside of the blade 10 are, therefore, an integral part of the blade 10. The handle 12 has two small holes 18 through the center by which the handle 12 may be snapped onto the mushroom pins 16. One end of the handle 12 has molded male threads 20 for attaching the handle 12 through the matching threads 22 to the blade 10. The other end of the handle 12 has a projection or tab 24 containing an opening 26 for insertion of a hook 28 during hanging for display or storage. Although a projection or tab 24 on the handle 12 is preferred, other means, such as a hook or a strap may be used.

Referring now to the drawings in detail, FIG. 1 shows a top view of the hawk, with the planar work surface, or blade 10 being shown. The handle 12 and the rubber ring 14 for cushioning the hand are illustrated by broken lines in FIG. 1, to indicate that they are on the underside of the work surface 10.

FIG. 2 is a cross sectional view of the hawk of FIG. 1 in the packing position taken along the line 2—2 as indicated in FIG. 1. In this position the handle 12 is attached to the mushroom pins 16 by their insertion into the holes 18 in the handle 12. The threads 20 at the attachment end of the handle 12 are preferably directed to the perimeter of the blade 10 but do not protrude beyond the edge. A circular rubber or foam pad 14 is illustrated as being concentrically placed around the threads 22 constituting the means by which the handle 12 is attached to the blade 10.

FIG. 3 is a perspective view showing the blade 10 and the handle 12 in the work position. A cross sectional view of the hawk in this work position, taken along the line indicated by 4—4 in FIG. 3 is illustrated in FIG. 4. In this position, the handle 12 is attached in a substantially normal position to the blade 10 by conventionally turning the threaded mounting end of the handle 20 into the correspondingly threaded mounting means 22 of the blade. FIG. 5 is a bottom plan view of the hawk with the handle 12 in the work position.

Referring now to FIG. 6, FIG. 6 is a sectional view showing the handle 12 in the hanging position. The hanging end of the handle 12 comprises the projection or tab 24 which is directed towards the perimeter of the blade 10 such that it protrudes beyond the edge to facilitate hanging. In this illustration, the hawk is suspended by a rod or hook 28 passing through the hole 26 in the tab 24 such as normally used on a pegboard display rack or behind a workbench.

Referring now to FIG. 7, FIG. 7 is an enlarged view of the mushroom pin 16 by which the handle 12 is attached to the blade 10. The bore of the hole 18 in the handle 12 preferably comprises a narrower diameter towards the end of the hole 18 such that a corner 28 is formed because of the difference in diameters of the central and end portions of the hole 18. The end of the mushroom pin 16 preferably comprises a lip 30 of a slightly larger diameter than the internal diameter at the end of the hole 18. By applying pressure to the handle 12 when the holes 18 are placed adjacent to the mushroom pins 16, the pins 16 may be forcibly "snap fit" into the handle 12. To remove the handle 12 from the hanging position, pressure applied in the opposite direction will cause the mushroom pins 16 to unsnap.

Although only certain embodiments of this invention have been disclosed herein it will be apparent that the invention is capable of still further modification, such as the insertion of a display card held on by the snap-fit handle in the hanging or display position of the hawk, and this application and the appended claims are intended to the cover the disclosed embodiments and any such modifications thereof as may fall within the scope of one skilled in the art.

What is claimed is:

1. A hawk comprising a planar member having a working surface having a first end and a second end opposite said first end and a mounting surface on the opposite side of said working surface, said working surface being capable of holding mortar or plaster-like material thereon in a work position, and a removably attachable handle having a first end and a second end opposite said first end, said handle comprising a hanging portion at said first end and mounting means at said second end for removably mounting said handle in a plurality of different optimal positions for providing a working position, a packing position and a hanging position for said hawk, said planar member further comprising means for removably attaching said handle to said mounting surface in said plurality of different optimal positions, said plurality of different optimal positions comprising said working position wherein said handle is removably attached to said mounting surface in a position substantially perpendicular to said working surface, said packing position wherein said handle is removably attached to said mounting surface in a position substantailly parallel to said work surface, such that said first end of said handle does not extend beyond said first end of the work surface, and said hanging position wherein said handle is removably attached to said mounting surface in a position substantially parallel to said work surface such that the hanging portion of said handle extends beyond said first end of the working surface for enabling hanging of said hawk by said hanging portion whereby said hawk may be hung for display or storage.

2. A hawk in accordance with claim 1 wherein said attaching means of said planar member for removably attaching said removably attachable handle in said work position comprises threads on said mounting surface of said planar member, and said mounting means on said removably attachable handle comprises threads threadably mateable with said threads on said mounting surface of said planar member, such that said handle may be manually threadably attached to said planar member in said work position.

3. a hawk in accordance with claim 2 wherein said threads on said mounting surface of said planar member are internal threads and said threads on said removably attachable handle are external threads.

4. A hawk in accordance with claim 1 wherein said hanging portion of said removably attachable handle comprises a tab extending from said first end of said handle, said tab further comprising a hole through which a hook for hanging said hawk may be inserted.

5. A hawk in accordance with claim 1 wherein;

said removably attachable handle further comprises a plurality of circular holes along the length of the handle and in a substantially straight line; and said attaching means of said planar member for removably attaching said handle in said packing or hanging positions comprises a plurality of mounting pins in substantially a straight line from the center of said planar member such that the mounting pins are insertable in said holes of said handle.

6. A hawk in accordance with claim 5 wherein the number of circular holes in said handle and the number of said mounting pins is 2.

7. A hawk in accordance with claim 5 wherein said mounting pins are mushroom shaped to enable said mounting pins to be snap fit into said handle.

* * * * *